United States Patent [19]

Alexander

[11] Patent Number: 4,941,622

[45] Date of Patent: Jul. 17, 1990

[54] PACKAGE ADAPTER

[76] Inventor: James L. Alexander, 1024 N. Tryon St., Charlotte, N.C. 28206

[21] Appl. No.: 435,494

[22] PCT Filed: Jun. 22, 1988

[86] PCT No.: PCT/US88/02155

§ 371 Date: Nov. 6, 1989

§ 102(e) Date: Nov. 6, 1989

[87] PCT Pub. No.: WO88/10229

PCT Pub. Date: Dec. 29, 1988

[30] Foreign Application Priority Data

Jun. 26, 1987 [AU] Australia ..... PI2732

[51] Int. Cl.[5] ..... B65H 49/06

[52] U.S. Cl. ..... 242/129.7; 242/46.3; 242/130.1; 242/130.4

[58] Field of Search ..... 242/129.7, 129.71, 130, 242/130.1, 130.4, 35.5 R, 46.2, 46.3

[56] References Cited

U.S. PATENT DOCUMENTS

| | | | |
|---|---|---|---|
| 1,686,102 | 10/1928 | Peterson | 242/35.5 R |
| 2,954,183 | 9/1960 | Townsend | 242/129.7 |
| 3,203,643 | 8/1965 | Zollinger | 242/129.71 |
| 4,485,987 | 12/1984 | Simpson | 242/130.1 |

*Primary Examiner*—Stanley N. Gilreath

[57] ABSTRACT

This invention relates to apparatus for receiving and mounting or supporting strand material packages formed by winding strand materials such as textile strands about hollow elongate cores. The apparatus has a central shaft, a rear support mounted on the shaft for engaging one end of a package core and a plurality of fingers for engaging the inside diameter of the core. The rear support and fingers together support a package, while accommodating cores of varying types and sizes. Operation of the rear support and fingers is coordinated by a linkage and a latch which interconnect those elements and the shaft.

10 Claims, 3 Drawing Sheets

PACKAGE ADAPTER

FIELD AND BACKGROUND OF INVENTION

This invention relates to an apparatus for handling textile strand material packages and more particularly to an apparatus capable of adapting to and holding a range of sizes and types of such packages.

As will be appreciated by those familiar with the textile arts, it is frequently desired to package strand material such as yarn or thread in wound packages in order to facilitate handling of the material between process steps in the manufacture of textile materials such as fabrics. One example, intended only for illustration of one application for the invention to be described more fully hereinafter, is in the winding of beams for looms, where many (sometimes hundreds or thousands of) packages of textile strand material are mounted in a creel and material is drawn from the packages and wound about a beam which is later mounted in a loom. Other examples will easily come to the mind of skilled persons.

Textile processes have used a wide variety and range of configurations and sizes of packages formed by winding strand material about elongate, hollow cores. Two examples only are the winding of yarn about right circular cylindrical cores into packages known sometimes as "cheeses" for their resemblance to certain types of cheese and the winding of yarn about conical cores. In both instances, the size of a package core and the size of the completed package can vary, with individual producers often choosing package configurations and sizes for reasons known only to themselves.

As will be appreciated by the thoughtful reader, the proliferation of package types and sizes presents problems for the manufacturer who consumes such packaged strands in the further processing of the textile materials, such as a weaving mill. Unless great care is taken in the consistent selection of strand materials and suppliers, strand materials in a number of various package configurations and types will come into a mill for use. As that occurs, some accommodation must be made to the various sizes and types of packages.

Prior to the present invention, such accommodation had only limited success. More particularly, attempts were made to have mounts capable of receiving more than one size and type of package, and some success had been achieved for adapters capable of receiving and handling two or perhaps three such sizes or types. Many such adapters have used fluid pressure actuators to assure that packages received are held in place for use. Others have provided components which must be manually exchanged in order to accommodate varying sizes and types of packages. As will be appreciated, both approaches have difficulties inherent in them of either increased complexity and risk of inoperativeness or increased need for operator attention and impairment of manufacturing efficiency.

BRIEF STATEMENT OF INVENTION

With the foregoing in mind, it is an object of this invention to provide an adapter capable of being easily mounted for use with a variety of textile machines and of receiving a wide range of types and sizes of textile strand material packages. In realizing this object of this invention, the adapter of this invention has an elongate spindle and elements mounted on the spindle for movement relative thereto and for engaging spaced locations longitudinally of and within an elongate core of a textile strand material package. The engaging elements are coupled one to another and to the spindle in such a way as to facilitate receiving and supporting a wide range of types and sizes of packages.

Yet a further object of this invention is to provide a package adapter of the type described which is capable of being easily and quickly reset by an operator to accommodate a different package that the one last previously used. In realizing this object of the present invention, the difficulties encountered heretofore with prior arrangements are reduced or eliminated.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

Figure 1:
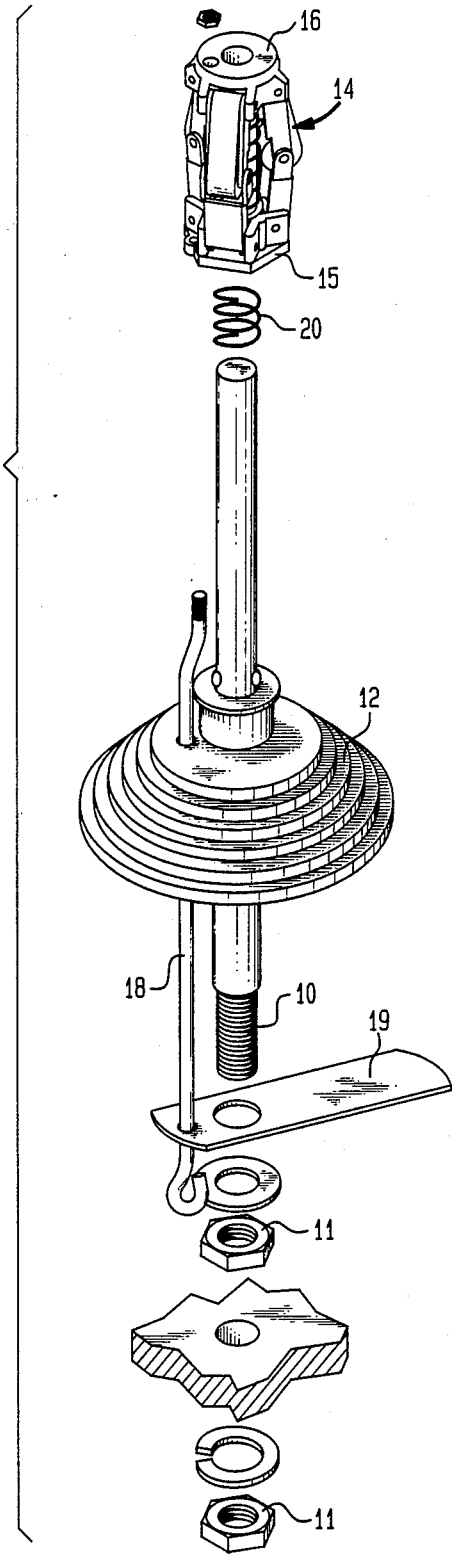
FIG. 1 is an exploded perspective view of an apparatus in accordance with this invention.

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

For purposes of the following discussion, a textile package formed of strand material such as yarn wound about an elongate hollow core will be presumed to have a base end and an end remote from the base, or remote end. In the instance of a conical core, the base end conventionally is the more open or larger diameter end. The adapter of the present invention has a central shaft 10 and means mounted on the shaft for engaging the base end of a package and the inside diameter of an elongate hollow core adjacent the remote end, as described more fully hereinafter.

The adapter of this invention has a central shaft member 10, which is engaged, in the form shown, by a pair of jam nuts 11 for holding the adapter in place. The end of the shaft 10 remote from the jam nuts 11 is a free end. The shaft 10 may be of circular cross section (as shown in the drawings) in order that the additional elements of the apparatus may freely rotate about the longitudinal axis of the shaft, or may have some regular polygonal shape such as a hex cross section in order that the additional elements may be secured against rotation.

Figure 2:
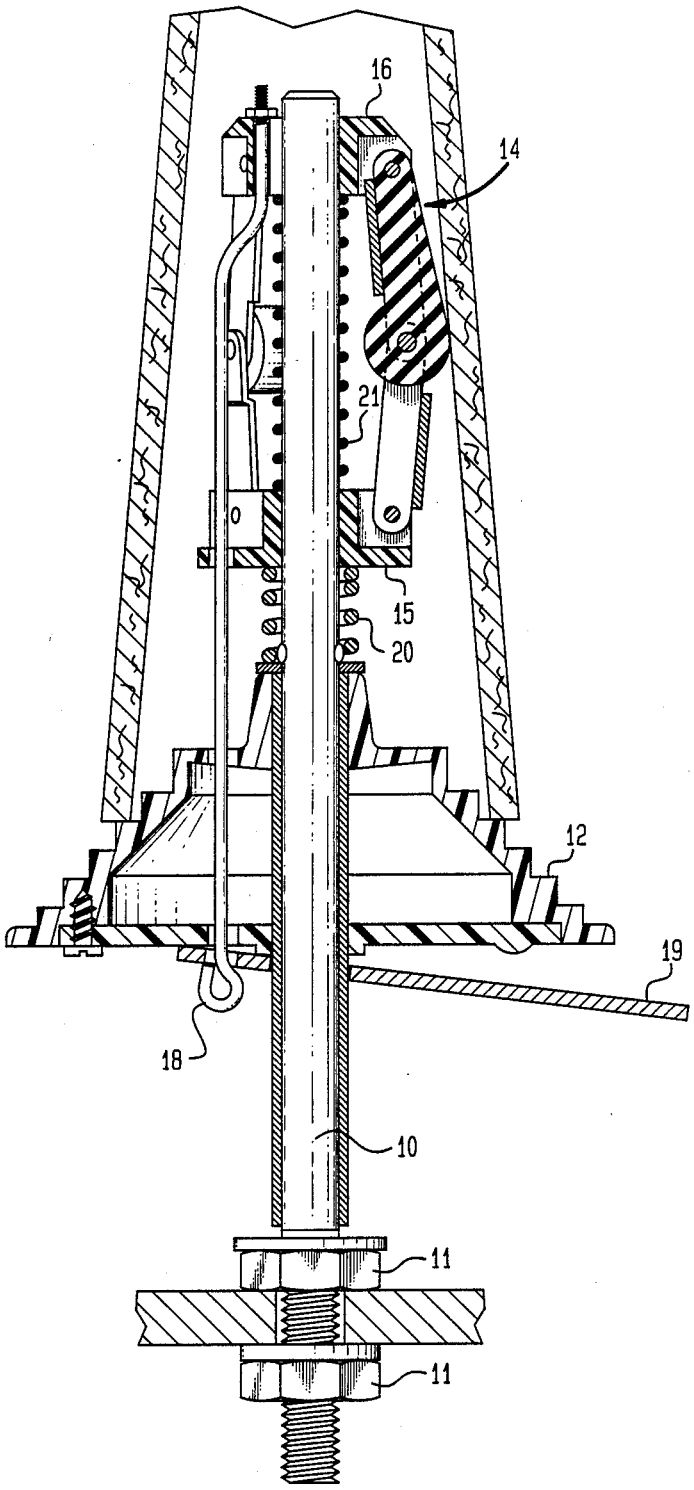
FIG. 2 is an elevation view in section, showing the apparatus of this invention in position of use.
Figure 3:
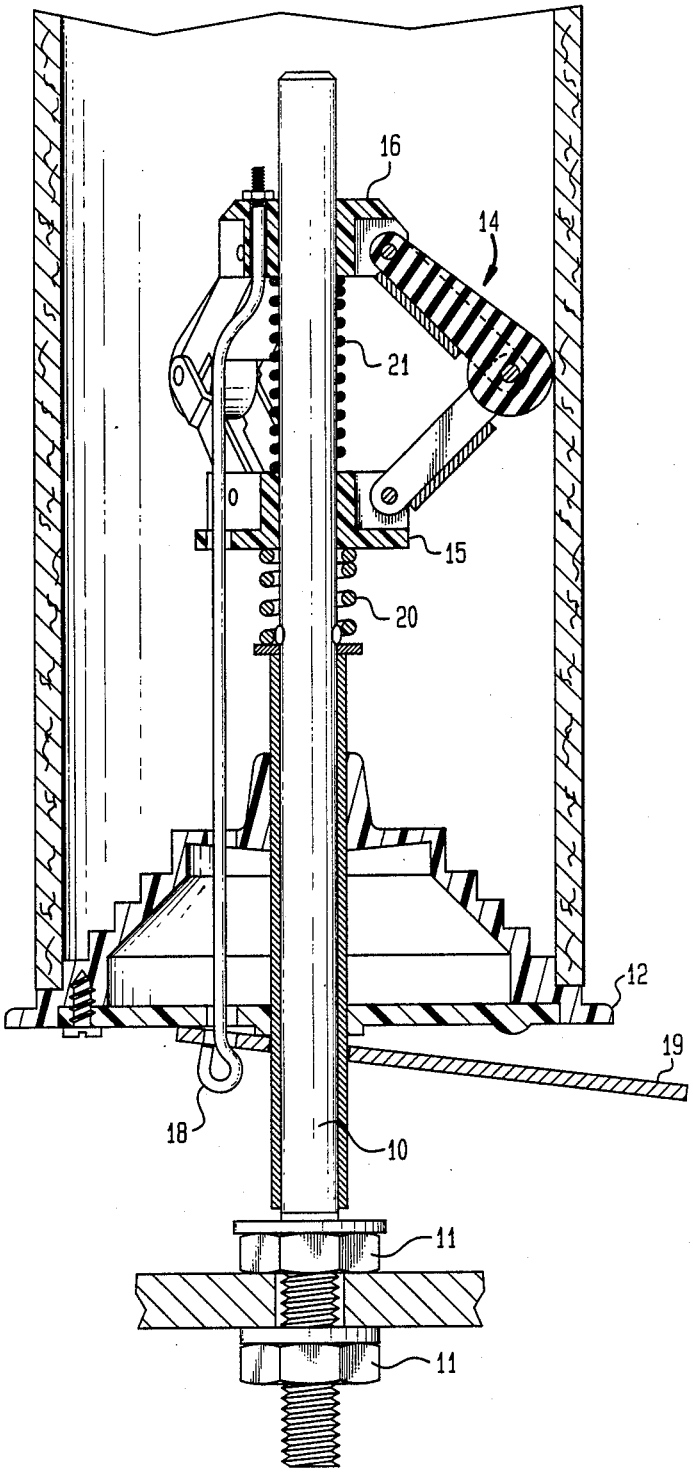
FIG. 3 is a view similar to FIG. 2 showing the device of FIGS. 1 and 2 with a cylindrical package core in place.

Mounted on the central shaft are a rear support 12 for engaging the base end of a package core and a plurality of gripping fingers 14 (preferably three) for engaging the inside diameter of a package core adjacent the remote end thereof. The fingers 14 are supported for pivotal movement between retracted positions drawn toward the axis of the shaft 10 and extended positions in which the outer ends of the fingers are urged outwardly against the inside diameter of the core of a package mounted on the adapter of this invention (FIGS. 2 and 3).

The fingers 14 are supported in a pair of finger mounts 15, 16 which are in turn mounted on the shaft 10. The rear support 12 and fingers 14 are coupled together by elements including the finger mounts 15, 16, linkage means in the form of a rod 18, and a latch mechanism formed by a locking arm 19 and finger mount springs 20, 21.

The locking arm 19 has an opening therein formed to have a diameter slightly larger than the outside diamter of the shaft 10. Thus the locking arm normally is slidable along the shaft. However, if tilted or canted relative to the shaft, the locking arm jams thereagainst, and does not move along the shaft. This latching characteristic has important uses in the apparatus of this invention.

The finger mount springs 20, 21 act between one finger mount 15 and the shaft 10 and between the finger mounts 15, 16 and cooperate with the linkage means and latch elements in causing a locking, knuckling movement of the fingers 14. Each finger 14 is formed by a pair of pivoted knuckle members and a core engaging member which preferably is formed of a frictional material such as rubber. The finger mount spring 21 which acts between the finger mounts 15, 16 urges the fingers 14 toward the collapsed or drawn in position. The other finger mount spring 20 which acts between one finger mount 15 and the shaft 10 provides enough movement for the mounts 15, 16 to avoid damage to the device and a latching force which acts through the rod 18 on the arm 19.

More particularly, with the adapter assembled and mounted for use, an operator may place a package of any desired type or size on the adapter and move the base of the package core toward the rear support. As the package engages the rear support 12, the support is moved along the shaft 10 and the linkage rod 18 causes one finger mount 16 to move toward the other mount 15 against the force of the spring 21 which acts therebetween, knuckling the fingers 14 outwardly toward the inside diameter of the core of the package being mounted. As the inside diameter is engaged by the fingers 14, continued movement of the package and the rear support 12 relative to the shaft 10 cause the locking arm 19 to tilt or cant as the other finger mount spring 20 is compressed. By the action of the latch mechanism formed by the elements described hereinabove, the fingers 14 and rear support 12 are held in the positions attained when a package is mounted.

When a mounted package is exhausted or otherwise is to be replaced, an operator may simply move the locking arm 18 against the force of the finger mount springs 20, 21, releasing the rear support 12 to move along the shaft 10 and the fingers 14 to collapse toward the axis of the shaft.

It will be appreciated that the specific latch mechanism shown and described may be varied by persons skilled in the applicable arts of machine design, once an understanding of the interaction among the fingers, rear support and main body is gained from a reading of this specification. More particularly, that interaction lies in the movement of the rear support relative to the shaft and concomitant outward pivoting of the fingers; the continued movement of the rear support and concomitant setting of the latch which holds the elements in position for supporting a package during its use; and the release of the elements to return to their starting positions upon the removal of a package core.

It will be noted that the rear support 12 is conical in configuration, and therefore is capable of receiving and engaging base ends of packages of a large variety of sizes and type, while centering all such packages about the shaft 10. Further, the fingers 14, when three in number, will similarly engage and center package cores of a wide variety of sizes and types, thereby contributing to a desired result of near universality for the adapter of this invention. An illustration of such universality is given by comparing FIG. 3 where the adapter in use with a conical core is shown and FIG. 4 where the adapter is shown in use with a right circular cylindrical core.

In the drawings and specifications there has been set forth a preferred embodiment of the invention and, although specific terms are used, the description thus given uses terminology in a generic and descriptive sense only and not for purposes of limitation.

What is claimed is:

1. An apparatus for receiving and engaging a package of strand material wound about an elongate hollow core and comprising:

an elongate central shaft means having a free end, a core end engaging rear support means mounted on said shaft means for movement therealong and for forming a sliding abutment for engaging an end of a package core positioned encircling said shaft means, a plurality of finger means mounted on said shaft means for movement relative thereto between retracted positions drawn toward the axis of said shaft means and extended positions urged outwardly into engagement with the inside diameter of a package core positioned encircling said shaft means, and means operatively interconnecting said rear support means, said finger means and said shaft means for moving said finger means from said retracted positions toward said extended positions upon movement of said rear support means along said shaft means in a direction away from said free end and for releasably latching said rear support means and said finger means in positions engaging the end and inside diameter of an elongate hollow core positioned encircling said shaft means.

2. An apparatus for receiving and engaging a package of strand material wound about an elongate hollow core and comprising:

an elongate central shaft means having a free end, a core end engaging rear support means mounted on said shaft means for movement therealong and for forming a sliding abutment for engaging an end of a package core positioned encircling said shaft means, a plurality of finger means mounted on said shaft means for movement relative thereto between retracted positions drawn toward the axis of said shaft means and extended positions in which said finger means are urged outwardly into engagement with the inside diameter of a package core positioned encircling said shaft means, linkage means operatively interconnecting said rear support means and said finger means for moving said finger means from said retracted positions toward said extended positions upon movement of said rear support means along said shaft means in a direction away from said free end, and latch means operatively interconnected with said rear support means and said finger means for releasably latching said rear support means and said finger means in positions engaging the end and inner diameter of an elongate hollow core positioned encircling said shaft means, said shaft means, rear support means, finger means, linkage means and latch means cooperating for mounting a strand material package for ready release of strand material during use and for facilitating changing of such packages as required.

3. An apparatus according to one of claim 1 or claim 2 further comprising resilient means acting between said shaft means and said finger means for urging said finger means toward said retracted position.

4. Apparatus according to one of claim 1 or claim 2 wherein said shaft means has a circular cross section and further wherein said rear support means and said finger means are mounted on said shaft means for rotation thereabout.

5. Apparatus according to one of claim 1 or claim 2 wherein said rear support means and said finger means are mounted on said shaft means and secured against rotation thereabout.

6. Apparatus according to one of claim 1 or claim 2 wherein said rear support means has a generally conical configuration for engaging core ends of differing diameters.

7. Apparatus according to one of claim 1 or claim 2 wherein said finger means comprises at least three finger members mounted for pivotal movement relative to said shaft means and spaced equally one from another about the circumference of said shaft means.

8. Apparatus according to one of claim 1 or claim 2 further comprising resilient means acting between said shaft means and said finger means for accommodating variation in the diameter of the circle described by the portions of said finger means most distant from said shaft means upon movement of said finger means to said extended position.

9. Apparatus according to one of claim 1 or claim 2 further comprising friction means forming a portion of said finger means for frictionally engaging and gripping the inside diameter of an elongate hollow core mounted on the apparatus.

10. An apparatus for receiving and engaging a package of strand material wound about an elongate hollow core and comprising:

an elongate central shaft means having a free end, a core end engaging rear support means mounted on said shaft means for movement therealong and for forming a sliding abutment for engaging an end of a package core positioned encircling said shaft means, said rear support means having a generally conical configuration for engaging core ends of differing diameters, at least three finger members mounted on said shaft means for movement relative thereto between retracted positions drawn toward the axis of said shaft means and extended positions in which said finger members are urged outwardly into engagement with the inside diameter of a package core positioned encircling said shaft means, friction means forming a portion of said finger members for frictionally engaging and gripping the inside diameter of an elongate hollow core mounted on the apparatus, resilient means acting between said shaft means and said finger members for urging said finger members toward said retracted position, linkage means operatively interconnecting said rear support means and said finger members for moving said finger members from said retracted positions toward said extended positions upon movement of said rear support means along said shaft means in a direction away from said free end, and latch means operatively interconnected with said rear support means, said finger members and said resilient means for releasably latching said rear support means and said finger members in positions engaging the end and inside diameter of an elongate hollow core positioned encircling said shaft means, said shaft means, rear support means, finger means, linkage means and latch means cooperating for mounting a strand material package for ready release of strand material during use and for facilitating changing of such packages as required.

* * * * *